US006002907A

United States Patent [19]

Berkes

[11] Patent Number: 6,002,907

[45] Date of Patent: Dec. 14, 1999

[54] LIQUID IMMERSION DEVELOPMENT MACHINE HAVING A RELIABLE NON-SLIDING TRANSFUSING ASSEMBLY

[75] Inventor: John S. Berkes, Webster, N.Y.

[73] Assignee: Xerox Corporation, Stamford, Conn.

[21] Appl. No.: 09/210,647

[22] Filed: Dec. 14, 1998

[51] Int. Cl.[6] ..... G03G 15/16; G03G 15/20; G03G 15/24

[52] U.S. Cl. ..... 399/307; 399/148; 399/302

[58] Field of Search ..... 399/308, 302, 399/307, 297, 148

[56] References Cited

U.S. PATENT DOCUMENTS

| | | | |
|---|---|---|---|
| 4,095,886 | 6/1978 | Koeleman et al. | 399/308 |
| 4,430,412 | 2/1984 | Miwa et al. | 399/307 X |
| 5,519,476 | 5/1996 | Dalal et al. | 399/307 |
| 5,761,594 | 6/1998 | Seto et al. | 399/302 |

*Primary Examiner*—Susan S. Y. Lee

*Attorney, Agent, or Firm*—Tallam I. Nguti

[57] ABSTRACT

A reliable non-sliding transfusing assembly is provided for receiving liquid toner images from an image bearing member. The transfusing assembly includes a continuous intermediate transfer belt forming a belt loop and having an inner surface and a toner image carrying outer surface; a first backing roller having a first diameter and mounted into contact with the inner surface of the belt loop for forming a toner image receiving nip between the belt loop and an image bearing member; and a second backing roller mounted oppositely from the first backing roller and into contact with the inner surface of the belt loop for forming a transfusing nip between the belt loop and an external roller. Importantly, the second backing roller consists of a large drive drum for the belt, and has a second diameter many times greater than the first diameter of the first backing roller so as to produce high quality transfused toner images by preventing belt sliding and slippage, as well as image smearing that would other wise result from a relatively small diameter drive roll.

8 Claims, 2 Drawing Sheets

LIQUID IMMERSION DEVELOPMENT MACHINE HAVING A RELIABLE NON-SLIDING TRANSFUSING ASSEMBLY

BACKGROUND OF THE INVENTION

This invention relates to liquid immersion development (LID) reproduction machines, and more particularly to such a machine having a reliable, non-sliding transfusing assembly for producing high quality transfused toner images by preventing intermediate belt sliding and slippage, as well as, image smearing that would other wise result from conventional belt transfusing assemblies.

Liquid electrostatographic reproduction machines are well known, and generally each includes an image bearing member or photoreceptor having an image bearing surface on which latent images are formed and developed as single color or multiple color toner images for eventual transfer to a receiver substrate or copy sheet. Each such reproduction machine thus includes a development system or systems that each utilizes a low solids content liquid developer material typically having about 2 percent by weight of fine solid particulate toner material of a particular color, dispersed in a hydrocarbon liquid carrier for developing latent images on the photoreceptor.

The developed images on the photoreceptor typically each contain only a low solids content of about 8 to 12 percent by weight of the toner particles in the hydrocarbon liquid carrier. Typically, the developed toner image or images at such a low concentration are metered and conditioned, and then transferred from the image bearing surface to an intermediate transfer member for example, and then hot or heat transferred from the intermediate transfer member to an image receiver substrate or copy sheet.

Because the metering and conditioning functions to go from a low solids content image to a high solids content image are conventionally carried out on the photoreceptor, this conventionally results in undesirably long photoreceptors, and hence correspondingly long or large machine footprints. Additionally, in image-on-image (IOI) multicolor machines, it is the image being built up on the photoreceptor that has to be conditioned, usually resulting in unacceptable degrees of image smear and cross-color contamination.

There is therefore a need for a LID reproduction machine that eliminates image conditioning on the photoreceptor and avoids at least the conventional problems above, thus resulting advantageously in relatively shorter photoreceptors, and improved IOI image quality.

SUMMARY OF THE INVENTION

In accordance with the present invention, there is provided a liquid immersion development (LID) reproduction machine having a reliable non-sliding transfusing assembly for receiving liquid toner images from an image bearing member. The transfusing assembly includes a continuous intermediate transfer belt forming a belt loop and having an inner surface and a toner image carrying outer surface; a first backing roller (s)having a first diameter and mounted into contact with the inner surface of the belt loop for forming a toner image receiving nip between the belt loop and an image bearing member; and a second backing roller mounted oppositely from the first backing roller and into contact with the inner surface of the belt loop for forming a transfusing nip between the belt loop and an external roller. Importantly, the second backing roller consists of a large drive drum for the belt, and has a second diameter many times greater than the first diameter of the first backing roller so as to produce high quality transfused toner images by preventing belt sliding and slippage, as well as image smearing that would other wise result from a relatively small diameter drive roll.

BRIEF DESCRIPTION OF THE DRAWINGS

Other aspects of the present invention will become apparent as the following description proceeds and upon reference to the drawing, in which.

DETAILED DESCRIPTION OF THE INVENTION

Figure 1:
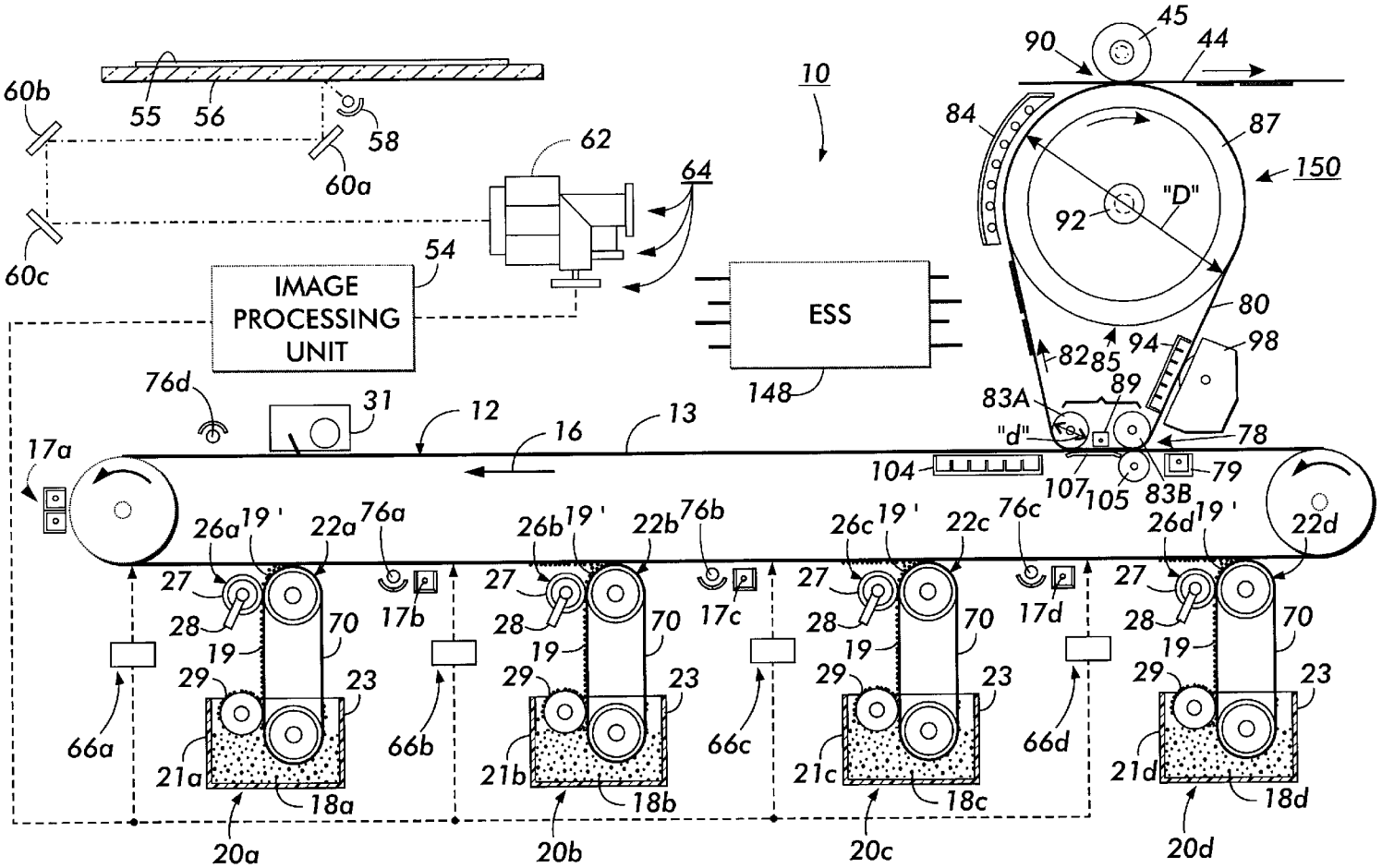
FIG. 1 is a vertical schematic of a color electrostatographic liquid immersion development (LID) reproduction machine incorporating a reliable non-sliding transfuse assembly in accordance with the present invention.
Figure 2:
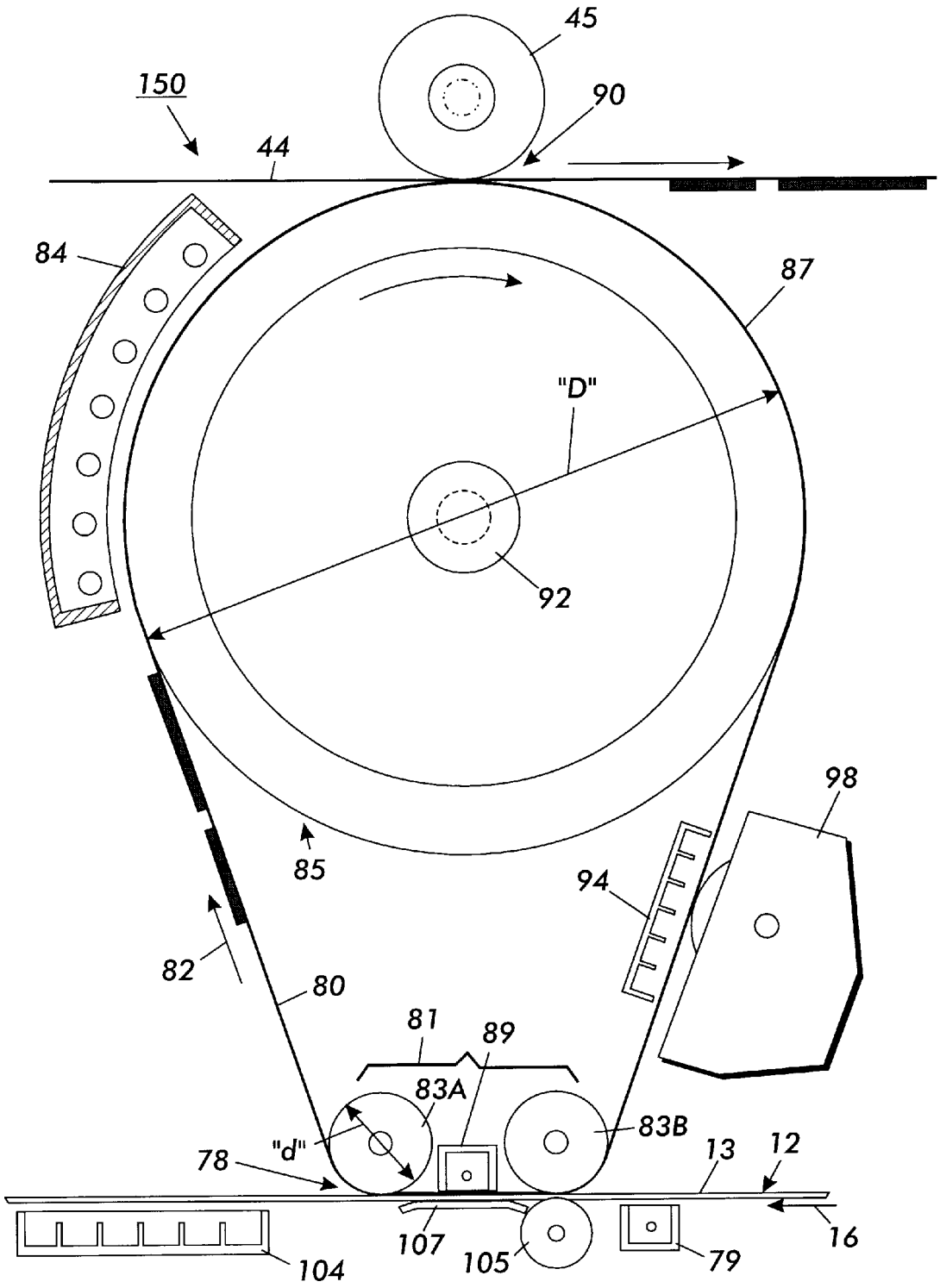
FIG. 2 is an enlarged detail illustration of the reliable non-sliding transfuse assembly of the present invention..

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the drawing, FIG. 1 of the reproduction machine will be shown hereinafter only schematically, and their operation described only briefly.

Referring now to FIG. 1, there is shown a color electrophotographic reproduction machine 10 incorporating a high solids content (HSC) image donor development apparatus 21*a*. Although a multiple color LID machine is illustrated, it is understood a single color LID machine is equally suitable. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors 60*a*, 60*b* and 60*c*, respectively through a set of lenses (not shown) and through a dichroic prism 62 to three charged-coupled devices (CCDs) 64 where the information is read. The reflected light is separated into the three primary colors by the dichroic prism 62 and the CCDs 64.

Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel, the color components as well as the color separation. Image processing unit 54 may contain a shading correction unit, an undercolor removal unit (UCR), a masking unit, a dithering unit, a gray level processing unit, and other imaging processing subsystems known in the art. The image processing unit 54 can store bitmap information for subsequent images or can operate in a real time mode.

The machine 10 includes a photoconductive imaging member or photoconductive photoreceptor 12 which is typically multilayered and has a substrate, a conductive layer, an optional adhesive layer, an optional hole blocking layer, a charge generating layer, a charge transport layer, a photoconductive or image forming surface 13, and, in some embodiments, an anti-curl backing layer. As shown, photoreceptor 12 is movable in the direction of arrow 16. The moving photoreceptor 12 is first charged by a charging unit 17*a*. A raster output scanner (ROS) device 66*a*, controlled by image processing unit 54, then writes a first complementary color image bitmap information by selectively erasing charges on the charged photoreceptor 12. The ROS 66*a* writes the image information pixel by pixel in a line screen registration mode. It should be noted that either discharged area development (DAD) can be employed in which discharged portions are developed or charged area development (CAD) can be employed in which the charged portions are developed with toner.

After the first electrostatic latent image has been recorded thus, photoreceptor 12 advances the electrostatic latent image to development station 20*a*. At development station 20*a*, there is provided a first high solids content donor development apparatus 21*a*, for developing the first latent image with charged toner particles. The high solids content donor development apparatus 21*a*, (21*b*, 21*c*, and 21*d* as below) includes a rotatable donor member 70 shown as a belt, (but could be a roller), rotating in the direction as shown, for advancing a low solids content (LSC) layer 19 of a liquid developer material 18*a*, preferably black toner developer material, from a source therefor, towards a development zone or nip 22*a*. The high solids content donor development apparatus 21*a*, for example, includes a low solids content (LSC) developer material source comprising a housing 23 containing LSC developer material 18*a*. A low solids content liquid developer material as discussed above typically is one having about 2 percent by weight of fine solid particulate toner material of a particular color, dispersed in a hydrocarbon liquid carrier for developing latent images, usually on a photoreceptor.

The donor development apparatus 21*a* includes a metering device 29 for regulating the thickness of the layer 19 of low solids content developer material on the donor member 70, and a conditioning device 26*a*, 26*b*, 26*c*, 26*d* for conditioning the layer 19 in order to yield or result in a high solids content (HSC) layer 19' on the belt 70 before it reaches the development nip 22*a*. As illustrated, the conditioning device 26*a* may include a roller 27 having perforations through its skin covering. Roller 27 contacts the layer 19 on donor member belt 70 and conditions the layer by compacting toner particles therein, and reducing the liquid carrier content thereof (thus increasing the percent solids). Preferably, the liquid carrier content is reduced sufficiently so that the percent solids in the LSC layer 19 is increased from about 2 percent to more than 20 percent by weight in the HSC layer 19'. Porous roller 27 of the device 26*a*, 26*b*, 26*c*, 26*d* may operate in conjunction with a vacuum 28 which removes liquid from the roller 27. A pressure roller (not shown), may also be mounted in pressure contact against the roller 27, to be used in conjunction with or in the place of the vacuum device 28, to squeeze the absorbed liquid carrier from the roller 27 for deposit into a receptacle.

Advantageously, metering, and conditioning a pre-development layer 19 of LSC developer material on the donor member 70 prior to image development, instead of doing so on the photoreceptor, allows for use of a shorter photoreceptor, and avoids image defects that otherwise would result from conditioning the image itself on the photoreceptor and after development. A biased electrode (not shown) may be positioned before the entrance to development zone or nip 22*a* to generate an AC field just prior to the entrance to development zone or nip 22*a* so as to disperse the toner particles substantially uniformly throughout the liquid carrier.

After the metering and conditioning of the layer 19 as above, the donor member belt 70 then advances the resulting HSC layer 19' into the development nip 22*a* where charged toner particles in the layer 19' pass by electrophoresis to the electrostatic latent image on the surface 13 to develop or form a first color separation image on the surface 13. As is well known, the charge of the toner particles is opposite in polarity to the charge on the photoconductive or image forming surface 13.

The first color separation image on photoreceptor 12 is then advanced to lamp 76*a* where any residual charge left on the photoconductive surface 13 of photoreceptor 12 is erased by flooding the photoconductive surface with light from lamp 76*a*.

As shown, according to the IOI (Image-On-Image) ReaD (Recharge Expose and Develop) process of the machine 10, the developed color separation image on photoreceptor 12 is subsequently recharged with charging unit 17*b*, and is next re-exposed by ROS 66*b*. ROS 66*b* superimposes a second color image bitmap information over the previous developed image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration.

At development station 20*b*, there is provided a second high solids content donor development apparatus 21*b*, for developing the second latent image with charged toner particles. As shown, the high solids content donor development apparatus 21*b* includes a rotatable donor member 70 shown as a belt rotating in the direction as shown, for advancing a layer 19 of a liquid developer material 18*b*, preferably cyan toner developer material containing charged toner particles, from a source therefor, towards a development zone or nip 22*b*. The donor development apparatus 21*b* includes a metering device 29 for regulating the thickness of the layer 19 of low solids content developer material on the donor member 70, and a conditioning device 26*b* for conditioning the layer 19 in order to yield or result in a high solids content (LSC) layer 19' on the belt 70, before it reaches the development nip 22*b*.

A biased electrode (not shown) can be positioned before the entrance to development zone or nip 22*b* for generating an AC field just prior to the entrance to development zone or nip 22*b* so as to disperse the toner particles substantially uniformly throughout the layer 19'. The charged toner particles in the layer 19' pass by electrophoresis to the second latent image on the photoreceptor, thus further building up a multicolor image thereon. The multicolor image or images on photoreceptor 12 are then advanced to lamp 76*b* where any residual charge left on the photoconductive surface is erased by flooding the photoconductive surface with light from lamp 76*b*.

To similarly produce the third image using the third toner color, for example magenta color toner, the developed images on moving photoreceptor 12 are recharged with charging unit 17*c*, and re-exposed by a ROS 66*c*, which superimposes a third color image bitmap information over the previous developed latent image. At development station 20*c*, there is provided a third high solids content donor development apparatus 21*c*, for developing the third latent image with charged toner particles. As shown, the high solids content donor development apparatus 21*c* includes a rotatable donor member 70 shown as a belt rotating in the direction as shown, for advancing a layer 19 of a liquid developer material 18*c*, preferably magenta toner developer material containing charged toner particles, from a source therefor, towards a development zone or nip 22*c*. The donor development apparatus 21*c* includes a metering device 29 for regulating the thickness of the layer 19 of low solids content developer material on the donor member 70, and a conditioning device 26*c* for conditioning the layer 19 in order to yield or result in a high solids content (LSC) layer 19' on the belt 70 before it reaches the development nip 22*c*.

A biased electrode (not shown) can be positioned before the entrance to development zone or nip 22*c* for generating an AC field just prior to the entrance to development zone or nip 22*c* so as to disperse the toner particles substantially uniformly throughout the layer 19'. The charged toner particles in the layer 19' pass by electrophoresis to the third latent image on the photoreceptor, thus further building up a multicolor image thereon. The multicolor image or images on photoreceptor 12 advances to lamp 76*c* where any residual charge left on the photoconductive surface is erased by flooding the photoconductive surface with light from lamp 76*c*.

Finally, to similarly produce the fourth image using the fourth toner color, for example yellow color toner, the multicolor image or images on moving photoreceptor 12 are recharged with charging unit 17*d*, and re-exposed by a ROS 66*d*. ROS 66*d* superimposes a fourth color image bitmap information over the previous developed latent images. At development station 20*d*, there is provided a fourth high solids content donor development apparatus 21*d*, for developing the fourth latent image with charged toner particles.

As shown, the high solids content donor development apparatus 21*d* includes a rotatable donor member 70 shown as a belt rotating in the direction as shown, for advancing a layer 19 of a liquid developer material 18*d*, preferably yellow toner developer material containing charged toner particles, from a source therefor, towards a development zone or nip 22*d*. The donor development apparatus 21*d* includes a metering device 29 for regulating the thickness of the layer 19 of low solids content developer material on the donor member 70, and a conditioning device 26*d* for conditioning the layer 19 in order to yield or result in a high solids content (LSC) layer 19' on the belt 70 before it reaches the development nip 22*d*.

A biased electrode (not shown) can be positioned before the entrance to development zone or nip 22*d* for generating an AC field just prior to the entrance to development zone or nip 22*d* so as to disperse the toner particles substantially uniformly throughout the layer 19'. The charged toner particles in the layer 19' pass by electrophoresis to the fourth latent image on the photoreceptor, thus further building up the multicolor image thereon.

As illustrated the reproduction machine 10 includes an electronic control subsystem (ESS) shown as 148 for controlling various components and operating subsystems of the reproduction machine. ESS 148 thus may be a self-contained, dedicated minicomputer, and may include at least one, and may be several programmable microprocessors for handling all the control data including control signals from control sensors for the various controllable aspects of the machine.

The resultant composite multicolor image, a multi layer image by virtue of different color toner development by the developing stations 20*a*, 20*b*, 20*c* and 20*d*, respectively having black, magenta, cyan and yellow, toners, is then advanced to a transfer station or nip 78 where it is transferred to the reliable, non-sliding transfusing assembly of the present invention, shown generally as 150. As illustrated, the reliable, non-sliding transfusing assembly 150 comprises an intermediate image carrying belt 80 that is moved in the direction of arrow 82, and defines a push-pull transfer zone 81 with the image bearing member 12, and a transfuse nip 90 with a back-up or pressure roll 45. In order to make the assembly reliable and non-sliding, the belt 80 is preferably made relatively short compared to conventional such intermediate transfer belts, and is mounted over at least two rollers 83A, 85.

One of the at least two rollers, 83A is a backing roller in the push-pull transfer zone 81 has a given diameter "d" and forms the image receiving nip 78 with the surface 13 of image bearing member 12, and the other roller 85 consists of a large drive drum 87 having a diameter "D" that is many times greater than the given diameter "d" of roller 83A. The large drive drum 87 advantageously provides reliable belt transport even in the presence of oil, thus preventing otherwise conventional sliding and image smearing. As shown, the transfer nip 78 may be formed by two backing rollers 83A, 83B for enabling effective transfer of high solids content image transfer-receiving by forming a non-sliding contact nip 78 with the image bearing member 12, which is backed by a biased back-up roller 105 which pushes the image to be transferred, and a crowning shoe member 107.

This is particularly important because an image-on-image (IOI) LID system ordinarily requires a push-pull transfer-receiving action within the nip 78 in order to effectively transfer-receive a multilayer image from photoreceptor or image bearing member 12 to an intermediate assembly. In accordance with the present invention, this is achieved by means of the extended contact nip 78 of push-pull transfer zone 81 between the photoreceptor 12 and the intermediate assembly 150, as well as by means, for example of, a backup-up roll 105, charging devices 79 and 89, and biased rollers 83B, 83A having opposite polarities for a push-pull effect. The backing roller 105 is placed opposite biased roller 83B as well as inside the photoreceptor in order to assure good contact formation at the beginning of the nip 78 of the push-pull transfer zone 81. In addition the crowned shoe member 107 is placed opposite the charging device 89 in order to maintain good contact between the photoreceptor and the intermediate transfer belt 80 throughout the transfer nip 78. The electrostatic push-pull transfer action requires that the biased roller 83B have the same electrical polarity as the toner, and that the second charging device 89 have the electrical polarity opposite to that of the toner.

As further shown, the reliable non-sliding transfusing assembly 150 includes radiant heater 84 (not heating pads as is conventional) mounted upstream of the transfuse nip 90 for heating the short intermediate belt 80 externally without inducing drag, as well as heating means 92 to heat the drum 87 internally for heating the belt 80 and image thereon through the transfuse nip 90 where the image is transfused onto a copy sheet or substrate 44. For heating requirements, it is preferable that the drum 87 be a low thermal conductivity and low thermal mass drum. The assembly 150 also includes an air cooling device 94 (not cooling pads as is conventional) mounted downstream of the transfuse nip 90 relative to movement (82) of belt 80, for reducing the temperature thereof prior to image reception within the transfer nip 78 without inducing drag.

The combined effect of the heating/cooling pads (when used instead of devices 84/94) on the intermediate belt 80 ordinarily would be substantial drag, which in the presence of carrier fluid has been found to cause some drive problems when the belt 80 is mounted over small and relatively equal diameter rollers such as a 3 inch transfuse drive roller. In accordance with the present invention however, such conventional drive problems are prevented by using the large drum 87 to both bear and transport the short intermediate belt 80, and by using a radiant heater 84 and an air cooling device 94, thus making the assembly 150 relatively non-sliding more reliable. Preferably, the short intermediate belt 80 forms an advantageous extended wrap (of greater than 180 degrees) around the drive drum 87 for providing reliable slip-free motion therefor even when heating and cooling pads are utilized.

As further shown, the assembly 150 includes a cleaning and oiling system 98 for cleaning, cooling, and pre-treating the surface of the intermediate belt 80 prior to it re-entering the image transfer-receiving nip 78. Ordinarily, the intermediate belt 80 is only cooled minimally by the cleaning/oiling system 98, and consequently the photoreceptor ordinarily would have to be able to take a thermal spike for greater than 0.5 sec. However, as shown, the present invention includes the cooling pads 94 for cooling the belt 80 prior to it re-entering the image transfer-receiving nip 78, and once through the nip 78, the photoreceptor or image bearing member 12 is additionally cooled by both an air cooled device 104, and the cleaning device shown as 31.

Thus, at the transfer station or nip 78, the resultant multicolor toner image is electrostatically transferred with the aid of push-pull action within the nip 78 to the reliable non-sliding transfusing assembly 150 of the present invention, which subsequently transfers the toner image onto an image receiving substrate or copy sheet 44. As shown, the reliable non-sliding transfusing assembly 150 includes a short intermediate transfer belt 80 that is suitable for transferring the toner image from the image forming surface 13, and eventually onto the substrate or copy sheet 44. The belt 80 is mounted along the path of movement of the image forming surface 13, and in contact or image transfer relationship with such surface 13 within the push-pull transfer zone 81 while forming the nip 78.

After image transfer from the surface 13 to the belt 80, the image bearing member 12 is cooled by a cooling device 104, and its surface 13 is subsequently cleaned by the cleaning device 31. The image bearing member 12 is additionally flooded with light from an erase lamp 76*d* in order to erase any residual charge therein, in preparation for recharging and re-imaging as above.

As further shown, the composite image after transfer from the surface 13 to the belt 80 may then be conditioned by a blotter device (not shown), and subsequently heat transferred and fixed, or transfused to the substrate or copy sheet 44 within the transfix nip 90 formed between the belt 80 and a heated roll 45. The belt 80 is thereafter cooled by the cooling device 94, and its surface cleaned by the cleaning and oiling system 98, prior to such surface rotating again into the nip 78 to receive another image from the surface 13.

As can be seen, there has been provided a reliable, non-sliding transfusing assembly 150 that is not prone to intermediate belt slippage as are conventional intermediate belt assemblies. Thus the transfusing assembly 150 includes a continuous, and relatively short (when compared to the length of the image bearing member or to conventional such belts) intermediate transfer belt 80 forming a belt loop and having an inner surface and a toner image carrying outer surface. The reliable, non-sliding transfusing assembly 150 also includes at least one first backing roller 83A having a first given diameter "d" and mounted into contact with the inner surface of the belt loop for forming a toner image receiving nip 78 between the belt loop and the image bearing member 12. The reliable, non-sliding transfusing assembly 150 includes a second backing roller, 85 that comprises the drive roller for the belt 80, and is mounted oppositely from the first backing roller 83A, and into contact with the inner surface of the belt loop for forming a transfusing nip 90 between the belt loop and the heated external roller 45.

Importantly, the second backing roller 85 comprises a large drum 87 having a diameter "D" many times greater than the diameter "d" of the first backing roller 83A, so as to produce high quality transfused toner images by preventing belt sliding and image smearing that would other wise result from a relatively small diameter drive roll. The short intermediate belt 80 mounted on the large drive drum 87 is heated upstream of the transfusing nip 90 by a non-drag inducing radiant heat source 84, and cooled downstream of such nip 90 by anon-drag inducing air cooling device 94. Replacing heating and cooling pads with the Radiant heater and air cooling device, advantageously reduces drag on the belt 80, and the belt 80 forms a large wrap of about 180 degrees with the drum 87 for providing positive and non-sliding or non-slipping driving of the belt 80, even under oily conditions.

While the invention has been described with reference to particular preferred embodiments, the invention is not limited to the specific examples shown, and other embodiments and modifications can be made by those skilled in the art without depending from the spirit and scope of the invention and claims.

What is claimed is:

1. A reliable non-sliding transfusing assembly for receiving liquid toner images from an image bearing member, the transfusing assembly comprising:

(a) a continuous intermediate transfer belt forming a belt loop and having an inner surface and a toner image carrying outer surface;

(b) a first backing roller mounted into contact with said inner surface of said belt loop for forming a toner image receiving nip between said belt loop and an image bearing member, said first backing roller having a first diameter; and (c) a second backing roller mounted oppositely from said first backing roller and into contact with said inner surface of said belt loop for forming a transfusing nip between said belt loop and an external roller, said second backing roller comprising a large drive drum for said belt, said large drive drum comprising a low thermal conductivity and low thermal mass drum and having a diameter many times greater than said first diameter of said first backing roller so as to produce high quality transfused toner images by preventing belt sliding and slippage, as well as image smearing that would other wise result from a relatively small diameter drive roll.

2. The transfusing assembly of claim 1, including a radiant heater for heating said toner image carrying outer surface of said intermediate transfer belt upstream of said transfusing nip, relative to movement of said intermediate transfer belt, without inducing drag in said intermediate transfer belt.

3. The transfusing assembly of claim 1, including an air cooling device for cooling said image carrying outer surface of said intermediate transfer belt downstream of said transfusing nip, relative to movement of said intermediate transfer belt, without inducing drag in said intermediate transfer belt.

4. The transfusing assembly of claim 1, including a first charging device mounted within said belt loop at said toner image receiving nip formed between said first backing roller and the image bearing member.

5. The transfusing assembly of claim 1, including a heating element mounted within said drum to heat said drum for heating said intermediate transfer belt mounted thereover.

6. A liquid immersion development (LID) machine for reliably producing quality liquid toner images, the LID machine comprising:

(a) a movable photoreceptor having an image bearing photoconductive surface;

(b) means for forming a transferable toner image on said image bearing photoconductive surface using liquid developer material containing charged toner particles;

(c) a reliable, non-sliding transfusing assembly, including:

(i) a continuous intermediate transfer belt forming a belt loop and having an inner surface and a toner image carrying outer surface;

(ii) a first backing roller mounted into contact with said inner surface of said belt loop for forming a toner image receiving nip between said belt loop and said image bearing photoconductive surface of said photoreceptor, said first backing roller having a first diameter; and (iii) a second backing roller mounted oppositely from said first backing roller and into contact with said inner surface of said intermediate transfer belt loop for forming a transfusing nip between said belt loop and an external roller, said second backing roller comprising a large drive drum for said intermediate transfer belt, and having a diameter many times greater than said first diameter of said first backing roller so as to produce high quality transfused toner images by preventing belt sliding and slippage, as well as image smearing that would other wise result from a relatively small diameter drive roll; and (d) a charging device mounted within said belt loop of said intermediate transfer belt at said toner image receiving nip.

7. The liquid immersion development (LID) machine of claim 6, including a cooling device mounted downstream of said toner image receiving nip, relative to movement of said intermediate transfer belt, for cooling said photoreceptor.

8. The liquid immersion development (LID) machine of claim 6, wherein said reliable, non-sliding transfusing assembly includes a radiant heater for heating said toner image carrying outer surface of said intermediate transfer belt upstream of said transfusing nip, relative to movement of said intermediate transfer belt, and without inducing drag in said transfer belt.

* * * * *